US008413803B2

(12) United States Patent
Questad et al.

(10) Patent No.: US 8,413,803 B2
(45) Date of Patent: Apr. 9, 2013

(54) STORAGE AND MIXING BOTTLE

(76) Inventors: Randy Questad, Battle Ground, WA (US); Jason Questad, Battle Ground, WA (US)

( * ) Notice: Subject to any disclaimer, the term of this patent is extended or adjusted under 35 U.S.C. 154(b) by 4 days.

(21) Appl. No.: 13/164,616

(22) Filed: Jun. 20, 2011

(65) Prior Publication Data

US 2012/0318765 A1 Dec. 20, 2012

(51) Int. Cl.
*B65D 25/08* (2006.01)

(52) U.S. Cl.
USPC ..... 206/221; 215/6; 215/11.1; 215/11.6

(58) Field of Classification Search ..... 206/219–221, 206/568; 215/6, 10, 11.1, 11.6, DIG. 8
See application file for complete search history.

(56) References Cited

U.S. PATENT DOCUMENTS 2,786,769 A * 3/1957 Greenspan ..... 206/221
4,651,899 A * 3/1987 Pauls et al. ..... 215/DIG. 8
6,474,861 B1 * 11/2002 De Laforcade ..... 206/219
6,889,826 B2 * 5/2005 Harada et al. ..... 206/219
7,546,919 B2 * 6/2009 Lee ..... 206/221
2009/0178940 A1 * 7/2009 Said ..... 206/221
2009/0301904 A1 * 12/2009 Bullard et al. ..... 206/221
2010/0213085 A1 * 8/2010 Belnap ..... 206/219

* cited by examiner

*Primary Examiner* — Luan K Bui
(74) *Attorney, Agent, or Firm* — Mark S. Hubert

(57) ABSTRACT

A multi-functional bottle contains two separate compartments, a first compartment for water or liquid storage, and a second compartment or holding chamber, for storage of a powdered formula. The doubled-walled holding chamber is comprised of a flexible, food-grade polymer. The holding chamber has a closed bottom-end, forming the bottle's base, and an open, sealable top-end for addition of the powdered formula, and for release of the powdered formula for mixing when so desired. Sealable top-end forms an airtight seal with an agitator cap. The agitator cap can easily be released by firmly pressing (depressing) the bottom-end of the holding chamber (and bottle), allowing the user to now mix the powdered formula with the water with a single hand.

13 Claims, 8 Drawing Sheets

STORAGE AND MIXING BOTTLE

BACKGROUND OF THE INVENTION

Parents and caregivers alike are familiar with the hungry screams of their infants. Often convenience makes powdered baby formula a first choice for feeding infants under one year of age. Typically, a baby bottle is partially filled with water, and a proper measurement (varies with manufacturer) of powdered formula is added to the water within the bottle. The cap and nipple are placed on the baby bottle and the caregiver shakes the bottle until all formula clumps have disappeared. Once the formula has been mixed, it spoils quickly, and therefore must be consumed quickly. When at home, this relatively easy task is mildly cumbersome when a baby is screaming with hunger, to downright laborious when it is three in the morning. However, when traveling with a baby it is all but impossible. There is often no running water, no level surface to measure the powdered formula, and no level surface to pour the powdered formula into the bottle.

SUMMARY OF THE INVENTION

Pre-measured amounts of baby formula and water are stored within a single baby bottle, indefinitely. When desired, the user can open the holding chamber, allowing the powdered formula to combine with the water, via shaking of the bottle, and dispensed to the baby for feeding with minimal effort.

DETAILED DESCRIPTION OF THE INVENTION

Figure 1:
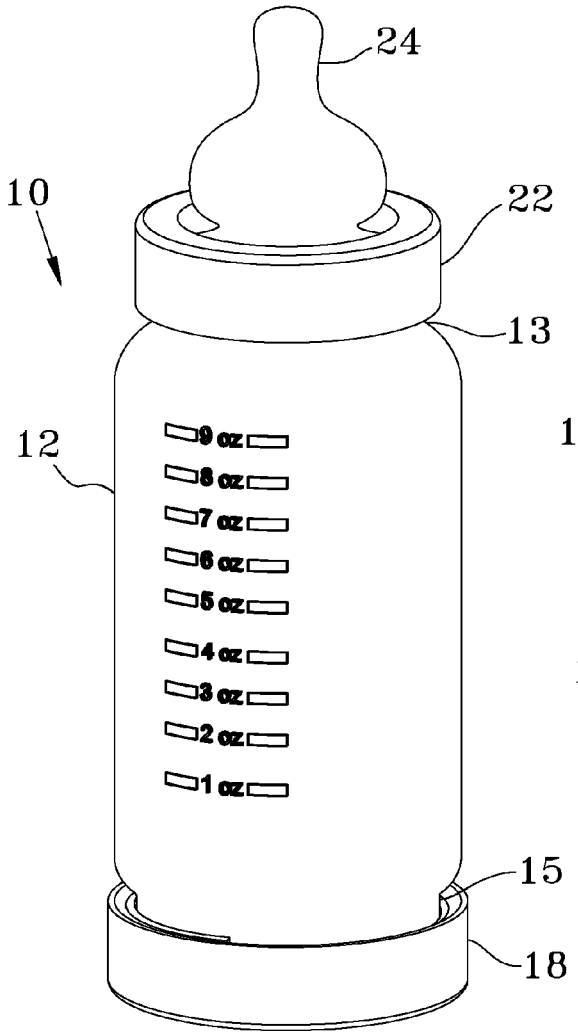
FIG. 1 is a front-perspective view of the baby bottle of the present invention.
Figure 2:
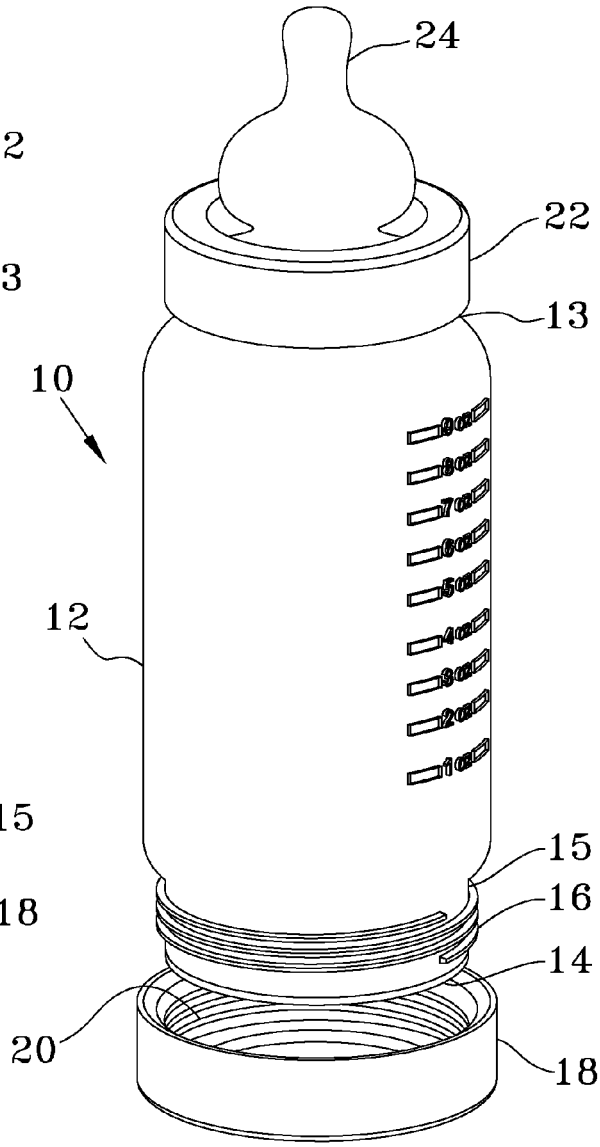
FIG. 2 is a partially exploded view of the baby bottle of the present invention.
Figure 3:
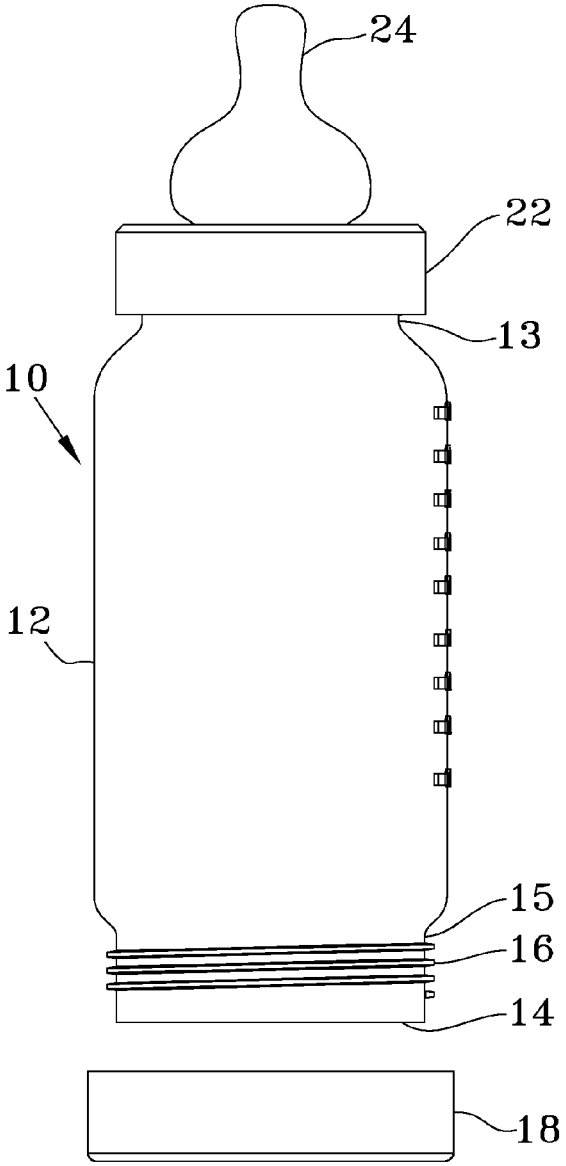
FIG. 3 is a side view of the baby bottle of the present invention with the bottom-end cap removed.
Figure 4:
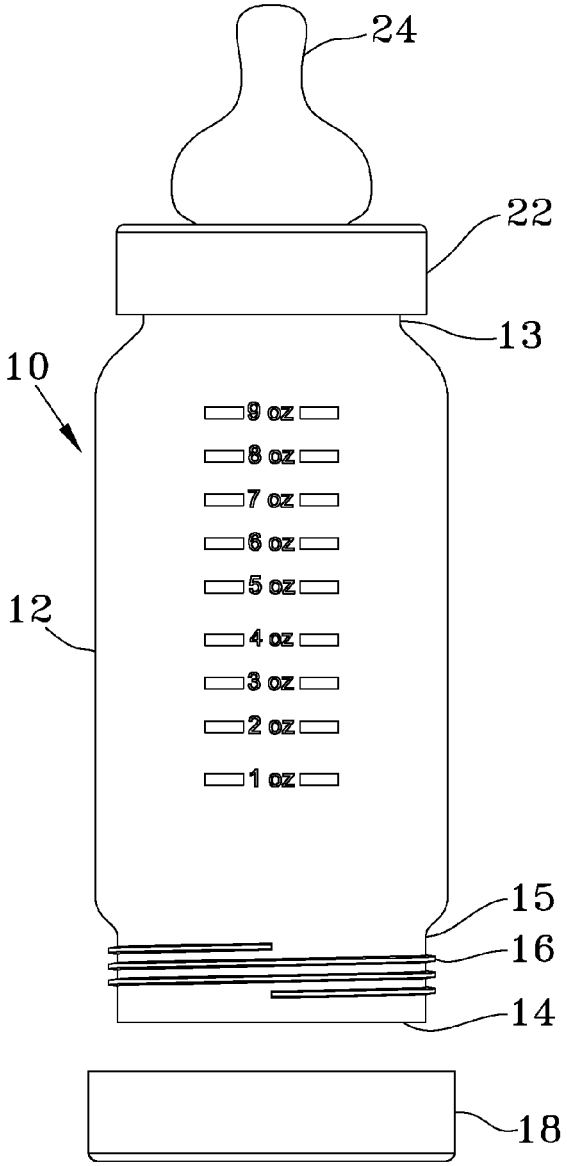
FIG. 4 is a front view of the baby bottle of the present invention with the bottom-end cap removed.
Figure 5:
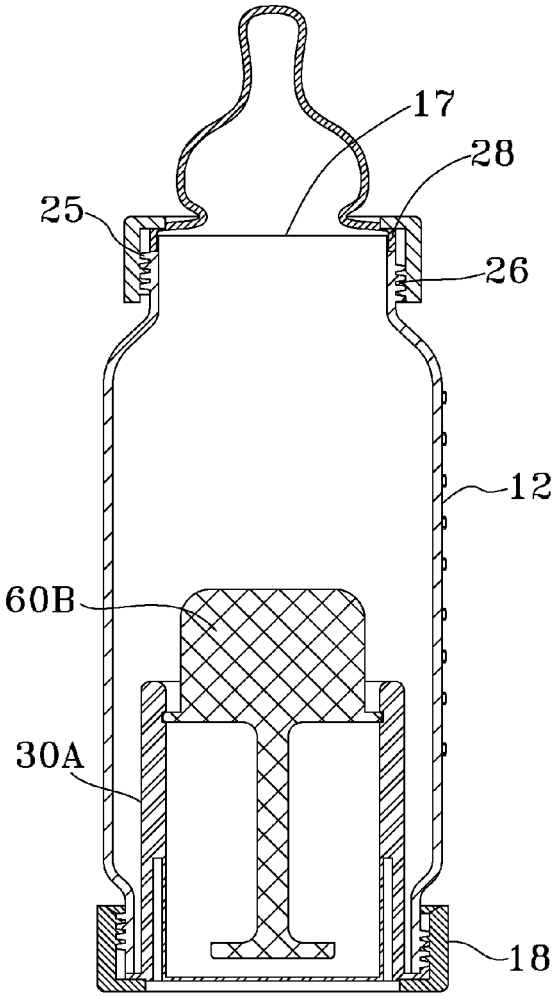
FIG. 5 is a front, cross-sectional view of a first embodiment of the holding chamber and agitation cap, within the baby bottle of the present invention.
Figure 6:
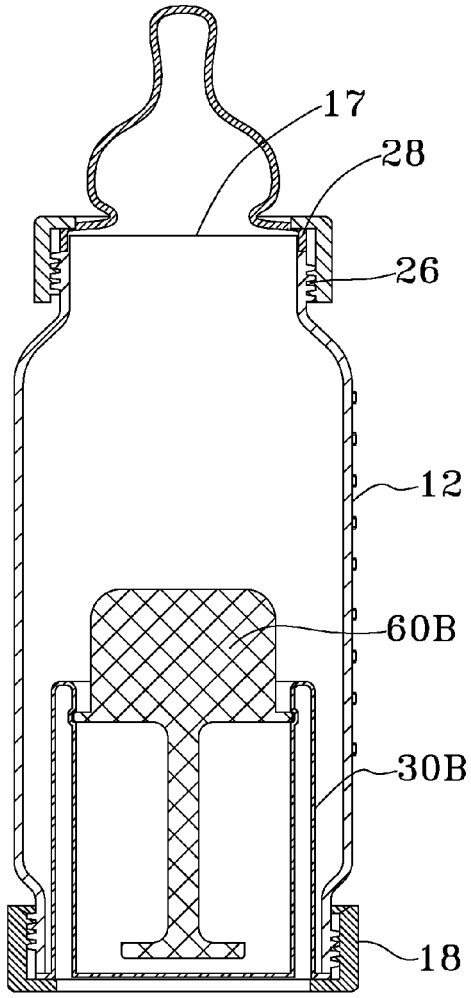
FIG. 6 is a front, cross-sectional view of a second embodiment of the holding chamber and agitation cap, within the baby bottle of the present invention.
Figure 7:
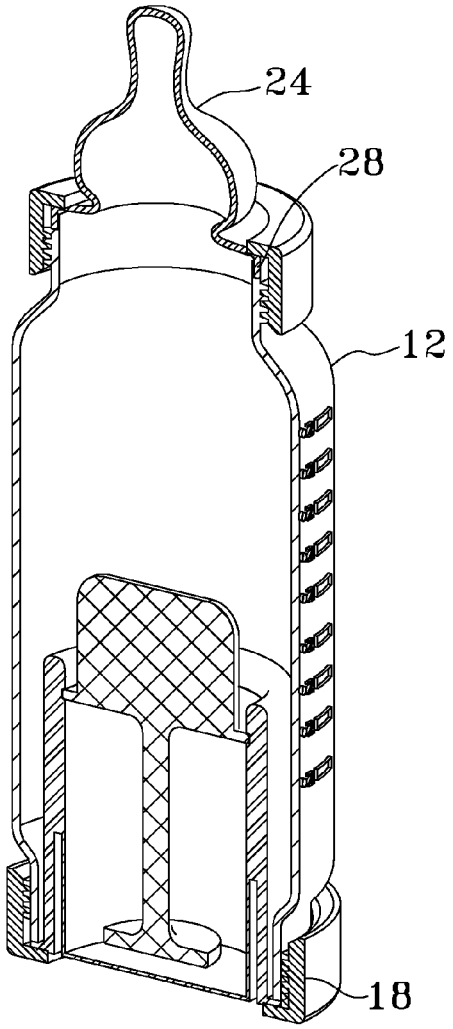
FIG. 7 is a perspective, cross-sectional view of a first embodiment of the holding chamber and agitation cap, within the baby bottle of the present invention.
Figure 8:
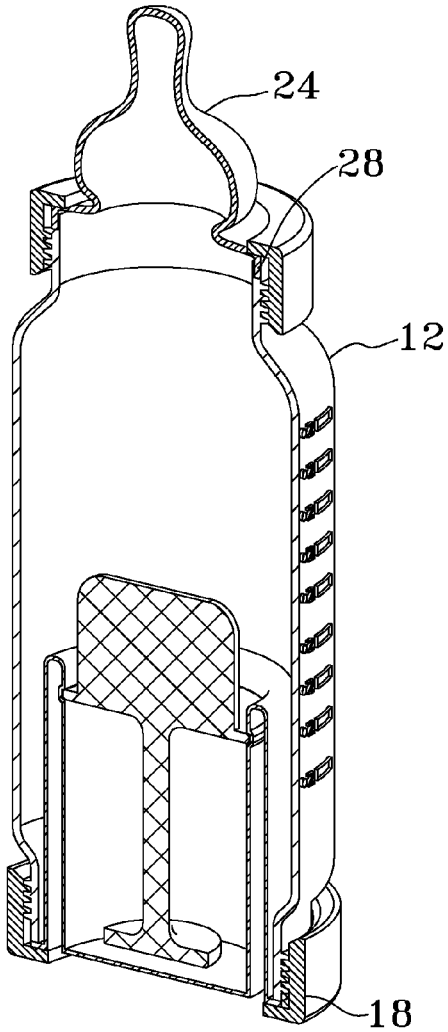
FIG. 8 is a perspective, cross-sectional view of a second embodiment of the holding chamber and agitation cap, within the baby bottle of the present invention.

FIGS. 1-8 show a baby bottle 10 in accordance with the present invention. Baby bottle 10 is shown in a 9-ounce version; however, there would be no difference in construction or operation of an 8-ounce version. Baby bottle 10 is comprised of a bottle portion 12, which is cylindrically shaped and tapers (reduced diameter) at a neck portion 13 and bottom portion 15. Bottle portion 12 is open at bottom end 14 and at top end 17 (see FIG. 5 for view of top end 17). Neck portion 13 and bottom portion 15 are identical, such that, with the omission of the graduation marks, the combination of bottle portion 12 (including neck portion 13 and bottom portion 15) is symmetrical about both its longitudinal and axial axes. Bottom end 14 has external sealing threads 16 for sealing engagement with internal sealing threads 20 of bottom sealing cap 18. Top end 17 (see FIG. 5) has external connecting threads 25 for sealing engagement with internal connecting threads 26 of top sealing cap 22. Top end 17 and bottom end 14 are identical such that bottom sealing cap 18 and top sealing cap 22 are interchangeable. Nipple 24 contains an annular flange 28. Preferably, nipple 24 and annular flange 28 are made of a single-piece, pliable food-grade rubber, or food-grade polymer. When annular flange 28 is tightened (compressed between) external connecting threads 25 with internal connecting threads 26 of top sealing cap 22 a leak-proof seal is formed.

Figure 9:
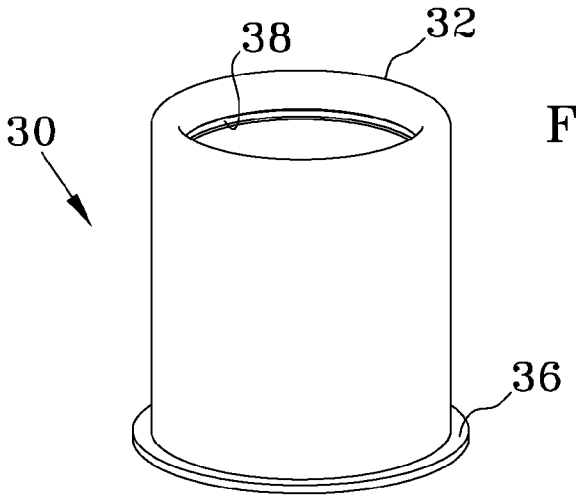
FIG. 9 is a top-front, perspective view of the holding chamber of the present invention.
Figure 10:
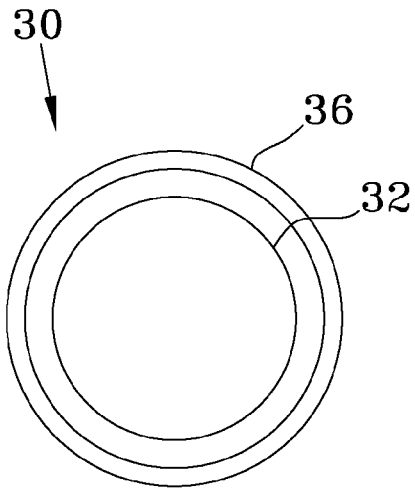
FIG. 10 is a top view of the holding chamber of the present invention.
Figure 11:
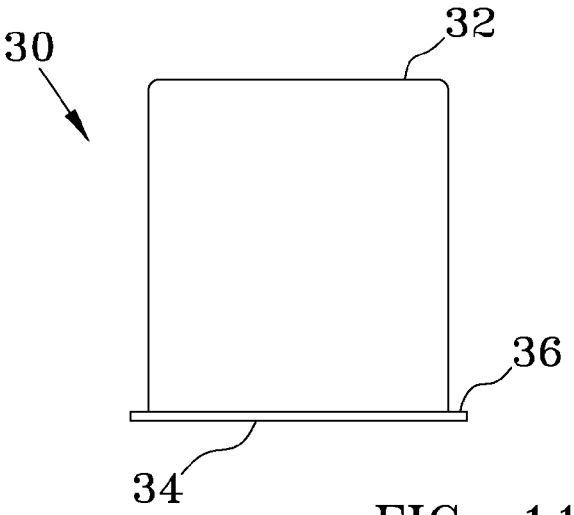
FIG. 11 is a front view of the holding chamber of the present invention.
Figure 12:
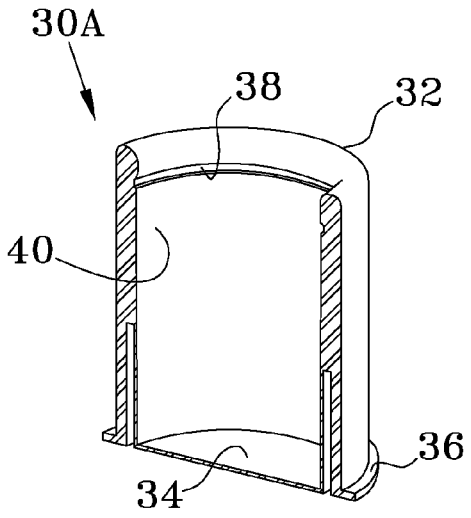
FIG. 12 is a perspective, cross-sectional view of a first embodiment of the holding chamber of the present invention.
Figure 13:
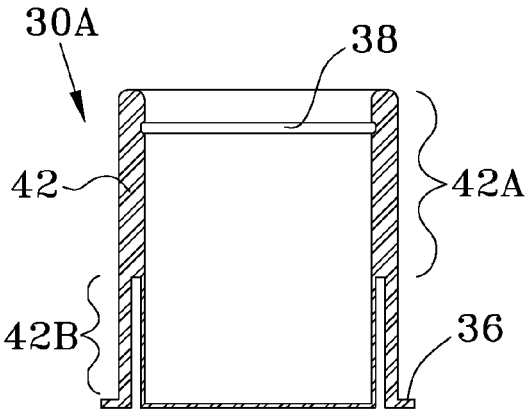
FIG. 13 is a front, cross-sectional view of a first embodiment of the holding chamber of the present invention.

FIGS. 9-11 illustrate all holding chambers 30 (whether first, second, or third embodiment), as all holding chambers 30 are identical in appearance. Holding chamber 30 is cylindrically shaped with an open top end 32 and closed bottom end 34. An annular sealing flange 36 resides around closed bottom end 34. Sealing recess 38 resides around the interior wall 40 (see FIG. 12) of open top end 32. Turning now to FIGS. 12 and 13, cross-sectional views of the first embodiment holding chamber 30A are visible. Specifically looking at FIG. 13, it can be seen that cylindrical wall 42 is partially solid in construction. Solid region 42A resides from open top end 32 to approximately the midpoint (not illustrated) of holding chamber 30A. Double-wall region 42B resides from closed bottom end 34 to approximately the midpoint of holding chamber 30A. Sealing flange 36 allows a water-tight seal to be formed, when sealing flange 36 is tightened (compressed), between the external sealing threads 16 of bottom end 14 and internal sealing threads 20 of bottom sealing cap 18, which can be seen in FIGS. 5 and 7. Holding chamber 30 and sealing flange 36 are made of a rigid, yet pliable rubber or polymer.

Figure 14:
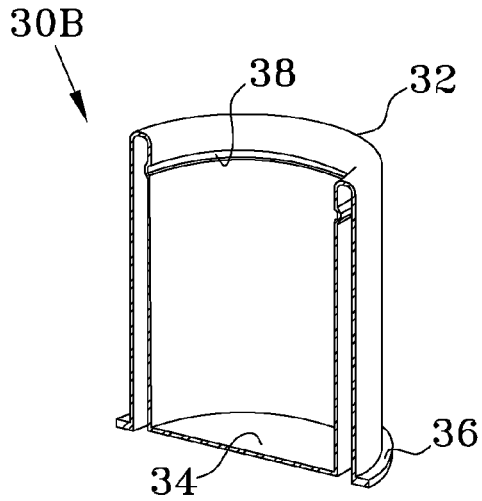
FIG. 14 is a perspective, cross-sectional view of a second embodiment of the holding chamber of the present invention.
Figure 15:
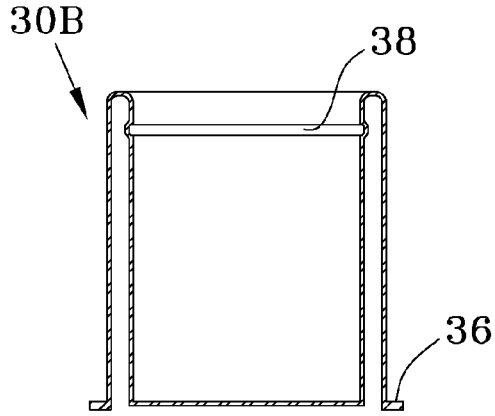
FIG. 15 is a front, cross-sectional view of a second embodiment of the hold chamber of the present invention.

Cross-sectional views of second embodiment holding chamber 30B are illustrated in FIGS. 14 and 15. Cylindrical wall 42 of holding chamber 30B has a hollow, doubled-wall construction.

Figure 16:
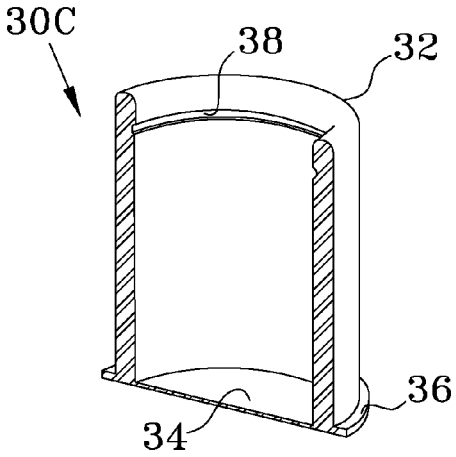
FIG. 16 is a perspective, cross-sectional view of a third embodiment of the holding chamber of the present invention.
Figure 17:
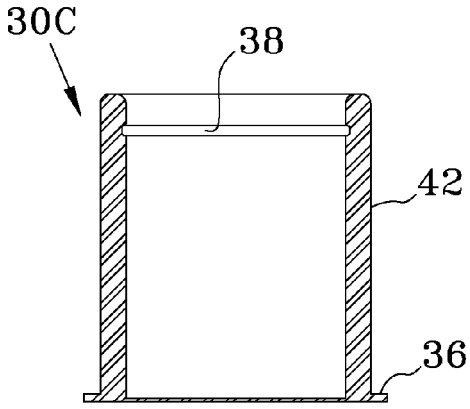
FIG. 17 is a front, cross-sectional view of a third embodiment of the holding chamber of the present invention.
Figure 18:
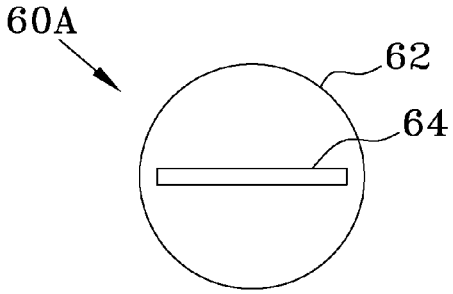
FIG. 18 is a top view of a first embodiment of the agitator cap of the present invention.
Figure 19:
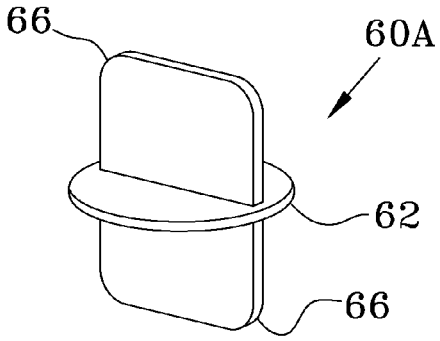
FIG. 19 is a perspective view of a first embodiment of the agitator cap of the present invention.
Figure 20:
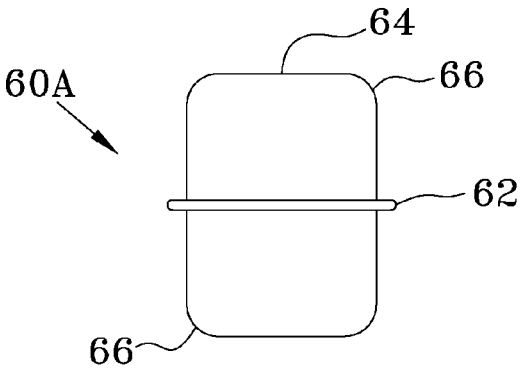
FIG. 20 is a front view of a first embodiment of the agitator cap of the present invention.
Figure 21:
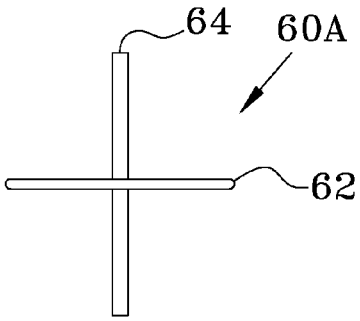
FIG. 21 is a side view of a first embodiment of the agitator cap of the present invention.
Figure 22:
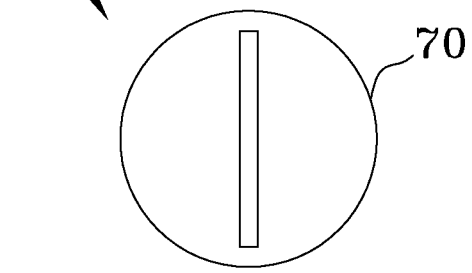
FIG. 22 is a top view of a second embodiment of the agitator cap of the present invention.
Figure 24:
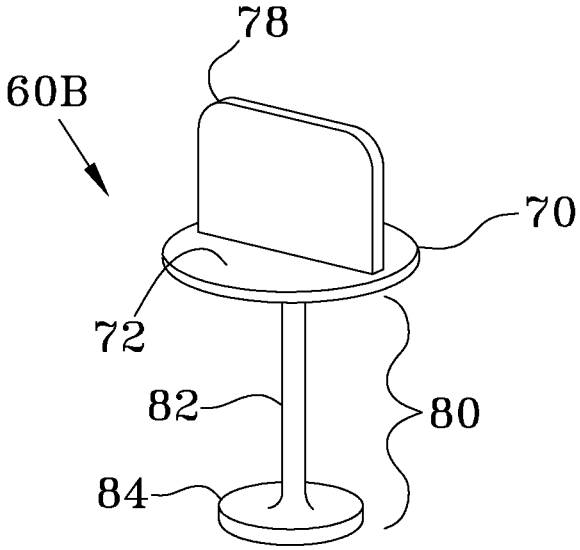
FIG. 24 is a side view of a second embodiment of the agitator cap of the present invention.
Figure 23:
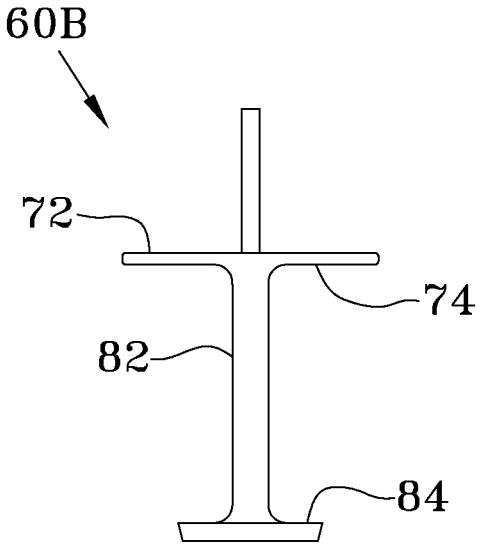
FIG. 23 is a perspective view of a second embodiment of the agitator cap of the present invention.
Figure 25:
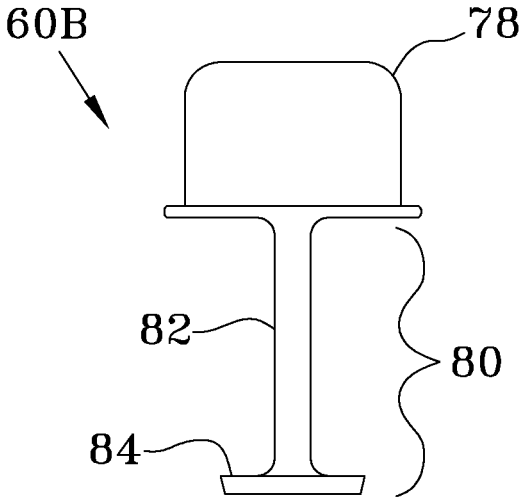
FIG. 25 is a front view of a second embodiment of the agitator cap of the present invention.

Finally, cross-sectional views of third embodiment holding chamber 30C are illustrated in FIGS. 16 and 17. Cylindrical wall 42 of holding chamber 30C is completely solid in construction.

There are three different embodiments of the holding chamber simply to accommodate varying manufacturing conditions. All holding chamber embodiments function similarly as will be discussed in further detail below.

A first embodiment of agitator cap 60A can be seen in FIGS. 18-21. The agitator cap 60 is comprised of circular body 62 perpendicularly intersected by rectangular body 64. Circular body 62 is designed to frictionally engage sealing recess 38, creating a water-tight seal. Rectangular body 64 has four rounded edges 66, to facilitate the mixing of powdered baby formula with the water during shaking, while not getting caught (trapped) within the neck portion 13 of baby bottle 10 or caught (trapped) within the nipple 24. Agitator cap 60A is made from a rigid rubber or polymer.

A second embodiment of agitator cap 60B is illustrated in FIGS. 22-25. Second embodiment agitator cap 60B is comprised of a second circular body 70 with a first face 72 and second face 74. Residing perpendicular to first face 72 is a second rectangular body 76. Second rectangular body has second rounded corners 78. Protruding from the midpoint (not visible) of second face 74 is plunger member 80. Plunger member 80 is comprised of an extension rod 82 and a third circular body 84. Agitator cap 60B serves a three purposes: 1) second circular body 70 is designed to frictionally engage sealing recess 38, creating a water-tight seal; 2) plunger member 80 facilitates the dislodging of second circular body 76 from sealing recess 38 when the user desires to combine the powdered baby formula and water; and 3) as agitator for facilitating mixing of the water and formula. Additionally, agitator cap 60B is designed to not get caught (trapped) within the neck portion 13 of baby bottle 10 or caught (trapped) within the nipple 24. Agitator cap 60B is made form a rigid rubber or polymer.

Generally, in operation, a user places the necessary volume of powdered baby formula into the holding chamber 30 (30A, 30B or 30C) via the open top end 32; see FIG. 9. Then the user secures the agitator cap 60A or 60B such that the agitator cap 60A or 60B is frictionally secured within sealing recess 38. Holding chamber 30 is the placed within bottle portion 12 via bottom end 14 and secured within the bottle portion 12 via bottom sealing cap 18. Bottle portion 12 is now filled with the desired volume of water via the open top end 17 and the nipple 24 is secured to the top end 17 via top sealing cap 22. When the user decides to prepare a bottle for feeding he/she firmly presses closed bottom end 34 via is his/her thumb for example. The force applied via the user's thumb travels up (energy wave) the cylindrical wall 42 causing it to slightly deform. This deformation causes agitator cap, 60A or 60B to "pop" out of sealing recess 38. The user can now simply shake the bottle to complete the mixing process. Additionally, if agitator cap 60B is being used, the user's thumb will contact third circular body 84 of plunger member 80. When using agitator cap 60B, the upward force from the user's thumb not only causes cylindrical wall 42 to deform, but also directly pushes the agitator cap 60B up via plunger member 80, further facilitating the release of the powdered formula from holding chamber 30.

Any one skilled in the art can appreciate various version of baby bottle 10 could be made without departing from the scope of this invention. For example, replacing the nipple 24 with a solid sealing cap for mixing would work well for athletes using powdered protein supplements after a workout. After mixing, the user would simply unscrew the solid sealing cap and drink directly from the bottle.

We claim:

1. A baby bottle comprising:

a vessel having a first open end, a second open end, and a first interior for storing a liquid;

a nipple connected to said first open end;

a cylindrically shaped holding chamber with a third open end and a closed end, forming a second interior for storing a powdered substance; wherein said closed end is retained at said second open end such that said holding chamber resides within said first interior of said vessel; wherein said holding chamber further comprises an annular sealing flange around said closed end; wherein said holding chamber further comprises a partially solid cylindrical wall, an interior wall, and an annular sealing recess formed around said interior wall at said third open end, for the sealing engagement of an agitator cap;

said agitator cap operatively disposed at said third open end forming a water-tight seal between said first interior and said second interior; and wherein said agitator cap is comprised of a circular body perpendicularly intersected by a rectangular body, and said rectangular body further comprises rounded corners.

2. The baby bottle of claim 1 wherein said baby bottle further comprises a releasable top sealing cap for the water-tight retention of said nipple at said first open end; and a bottom sealing cap for the water-tight retention of said holding chamber at said second open end.

3. The baby bottle of claim 2 wherein said top sealing cap and said bottom sealing cap are identical.

4. A baby bottle comprising:

a first open end, a second open end, and a first interior for storing a liquid;

a nipple with an annular flange connected to said first open end, via a releasable top sealing cap for water-tight retention;

a cylindrically shaped holding chamber with a third open end and a closed end, forming a second interior for storing a powdered substance; wherein said closed end is retained at said second open end such that said holding chamber resides within said first interior via a releasable bottom sealing cap and said closed end forming the bottom of said bottle;

said holding chamber comprising an annular sealing flange, a cylindrical wall, an interior wall, and an annular sealing recess formed around said interior wall at said third open end;

an agitator cap operatively disposed at said third open end forming a water-tight seal between said first interior and said second interior, wherein said agitator cap is comprised of a circular body perpendicularly intersected by a rectangular body, and said rectangular body further comprises rounded corners.

5. The baby bottle of claim 4 wherein said agitator cap is comprised of a second circular body with a first face and a second face;

a rectangular body residing perpendicular to said first face, said rectangular body having rounded corners;

a plunger member protruding from the midpoint of said second face, said plunger member comprising an extension rod and a third circular body residing perpendicular to said extension rod.

6. The baby bottle of claim 4 wherein said cylindrical wall is hollow.

7. The baby bottle of claim 4 wherein said cylindrical wall is partially solid.

8. The baby bottle of claim 5 wherein said cylindrical wall is hollow.

9. The baby bottle of claim 5 wherein said cylindrical wall is partially solid.

10. The baby bottle of claim 4 wherein said baby bottle further comprises a releasable top sealing cap for the water-tight retention of said nipple at said first open end; and a bottom sealing cap for the water-tight retention of said holding chamber at said second open end, wherein said top sealing cap and said bottom sealing cap are identical.

11. The baby bottle of claim 5 wherein said baby bottle further comprises a releasable top sealing cap for the water-tight retention of said nipple at said first open end; and a bottom sealing cap for the water-tight retention of said holding chamber at said second open end, wherein said top sealing cap and said bottom sealing cap are identical.

12. A baby bottle comprising:

a vessel with a first open end, a second open end, and a first interior for storing a liquid;

a nipple with an annular flange connected to said first open end, via a releasable top sealing cap for the water-tight retention;

a cylindrically shaped holding chamber with a third open end and a closed end, forming a second interior for storing a powdered substance; wherein said closed end is retained at said second open end such that said holding chamber resides within said first interior via a releasable bottom sealing cap;

said holding chamber comprising an annular sealing flange, a hollow cylindrical wall, an interior wall, and an annular sealing recess formed around said interior wall at said third open end, said closed end forming the bottom of said vessel;

an agitator cap operatively disposed at said third open end forming a water-tight seal between said first interior and said second interior, and comprised of a circular body perpendicularly intersected by a rectangular body, said rectangular body further comprises rounded corners;

a releasable top sealing cap for the water-tight retention of said nipple at said first open end; and a bottom sealing cap for the water-tight retention of said holding chamber at said second open end, wherein said top sealing cap and said bottom sealing cap are identical.

13. The baby bottle of claim 12 wherein said cylindrical wall is partially solid in construction.

* * * * *